United States Patent [19]

McAllister

[11] 4,277,922

[45] Jul. 14, 1981

[54] FRAME ASSEMBLY APPARATUS AND METHOD OF MAKING SAME

[76] Inventor: Jack G. McAllister, P.O. Box 22494, Robbinsdale, Minn. 55422

[21] Appl. No.: 117,774

[22] Filed: Feb. 1, 1980

Related U.S. Application Data

[60] Continuation-in-part of Ser. No. 857,435, Dec. 5, 1977, Pat. No. 4,190,990, which is a continuation-in-part of Ser. No. 712,351, Aug. 6, 1976, abandoned, which is a division of Ser. No. 255,688, May 22, 1972, Pat. No. 3,973,370.

[51] Int. Cl.[3] ..... E04B 1/32

[52] U.S. Cl. ..... 52/81; 52/86; 52/108; 52/745; 135/1 R

[58] Field of Search ..... 52/80, 81, 86, 108, 52/745; 135/1 R

[56] References Cited

U.S. PATENT DOCUMENTS

| | | | |
|---|---|---|---|
| 2,840,199 | 6/1958 | Marris | 52/108 |
| 3,053,351 | 9/1962 | Fulcher . | |
| 3,217,328 | 11/1965 | Miller | 52/108 |
| 3,375,624 | 4/1968 | Mikulin . | |
| 3,559,353 | 2/1971 | Partridge . | |
| 3,676,976 | 7/1972 | McAllister | 52/81 |
| 3,710,806 | 1/1973 | Kelly . | |
| 3,732,656 | 5/1973 | Robinsky | 52/108 |
| 3,768,218 | 10/1973 | Blaski | 52/81 |
| 3,838,703 | 10/1974 | Zeigler | 52/81 |
| 3,913,105 | 10/1975 | Williamson | 52/108 |

FOREIGN PATENT DOCUMENTS 414506 8/1946 Italy .

*Primary Examiner*—Price C. Faw, Jr.
*Assistant Examiner*—Henry E. Raduazo
*Attorney, Agent, or Firm*—Burd, Bartz & Gutenkauf

[57] ABSTRACT

A frame assembly and method of making a frame assembly over an area with a plurality of strut assemblies connected to hubs and peripherally located anchors. The hubs pivotally connect the adjacent ends of the strut assemblies to complete a network of hubs and strut assemblies covering the surface. Each strut assembly has a leaf spring strut that is biased to a curved contracted position. The curved struts are bowed contracted struts and S-curved contracted struts. A holding member engages separate portions of the strut to retain the strut in its biased curved contracted position. The contracted strut assemblies are pivotally attached to the anchors and hubs on the surface. The frame assembly is erected by releasing the holding members to allow the strut assemblies to spring to their natural elongated positions.

45 Claims, 26 Drawing Figures

FRAME ASSEMBLY APPARATUS AND METHOD OF MAKING SAME

CROSS REFERENCE TO RELATED APPLICATION

This Application is a continuation-in-part of U.S. application Ser. No. 857,435, filed Dec. 5, 1977, now U.S. Pat. No. 4,190,990. Application Ser. No. 857,435 is a continuation-in-part of U.S. application Ser. No. 712,351, filed Aug. 6, 1976, now abandoned. Application Ser. No. 712,351 is a division of U.S. application Ser. No. 255,688, filed May 22, 1972, now U.S. Pat. No. 3,973,370, granted Aug. 10, 1976.

SUMMARY OF INVENTION

The invention relates to a frame assembly located over a selected surface and a method of erecting the frame assembly above the surface. The frame assembly has a network of interconnected strut assemblies and hubs. Anchors secure the outer strut assemblies to a fixed support surrounding the surface. The strut assemblies have spring struts that are retained in curved contracted positions. The struts are provided with a bowed or arcuate curve. Alternatively, S-curved struts can be used in the strut assemblies. The strut assemblies have one or more curved contracted struts that have elastic memory which returns the struts to their normal elongated positions. The hubs are cylindrical units having an annular groove to accommodate portions of the strut assemblies and pivot means for pivotally connecting the strut assemblies to the hubs. Pivot means pivotally connect the outer strut assemblies to the anchors to allow the strut assemblies to move in an upward direction away from the surface.

The frame assembly is erected by allowing the strut assemblies to expand or extend to their natural elongated positions. This is accomplished by releasing the holding means so that the curved struts will move to slightly curved positions due to the spring or biasing memory of the strut material. When all of the strut assemblies have been expanded, the frame assembly is an arched network of strut assemblies and hubs that extend over the surface.

The frame assembly is made of a minimum of different structured parts. The strut assemblies, hubs, and anchors are respectively identical so that the network of struts and hubs can be assembled with a minimum of time and labor on the supporting surface. The erection of the frame assembly above the surface is a self-raising process accomplished by releasing the holding means that holds the strut assemblies in their curved contracted positions. The construction and erection of the frame assembly over the surface does not require temporary scaffolding nor lifting machinery.

IN THE DRAWINGS

DESCRIPTION OF PREFERRED EMBODIMENTS

The frame assembly and method of erecting a frame assembly over a surface disclosed in co-pending U.S. patent application Ser. No. 857,435, filed Dec. 5, 1977, now U.S. Pat. No. 4,190,990, is hereby incorporated by reference. This Application discloses a frame assembly comprised of a plurality of linear struts having first and second members that can be moved longitudinally relative to each other to increase the length of the struts. Contracted struts are connected together with connectors on the surface. The frame assembly is erected by longitudinally elongating the struts to move the frame assembly upwardly from the surface to a general dome configuration.

Figure 1:
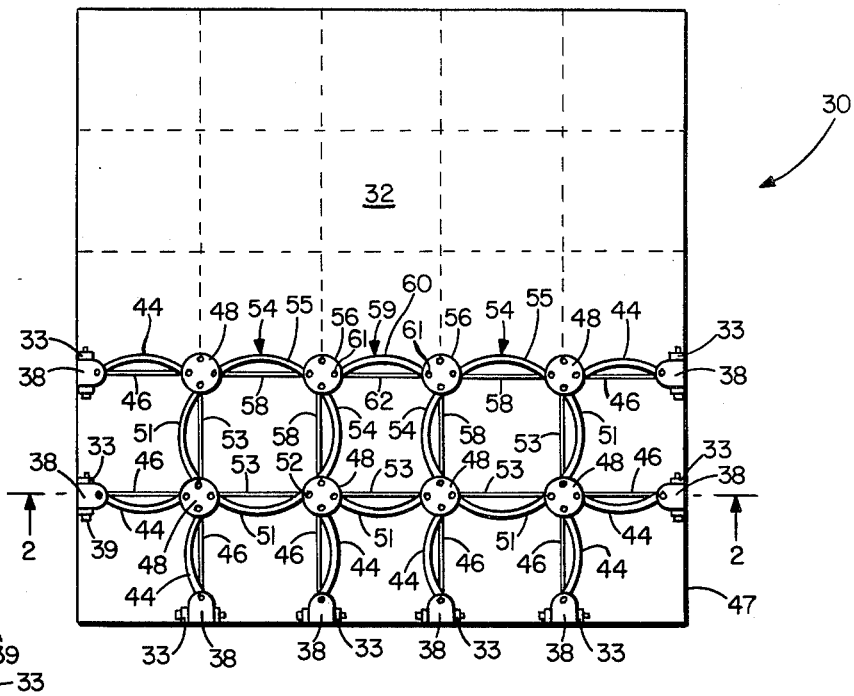
FIG. 1 is a top view of a square layout of the frame assembly of the invention before the frame assembly is erected.
Figure 2:
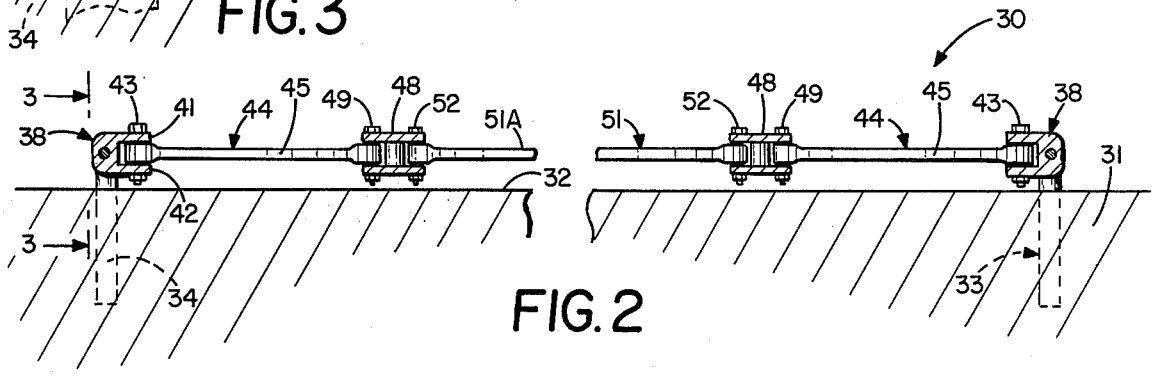
FIG. 2 is an enlarged foreshortened sectional view taken along the line 2—2 of FIG. 1.
Figure 11:
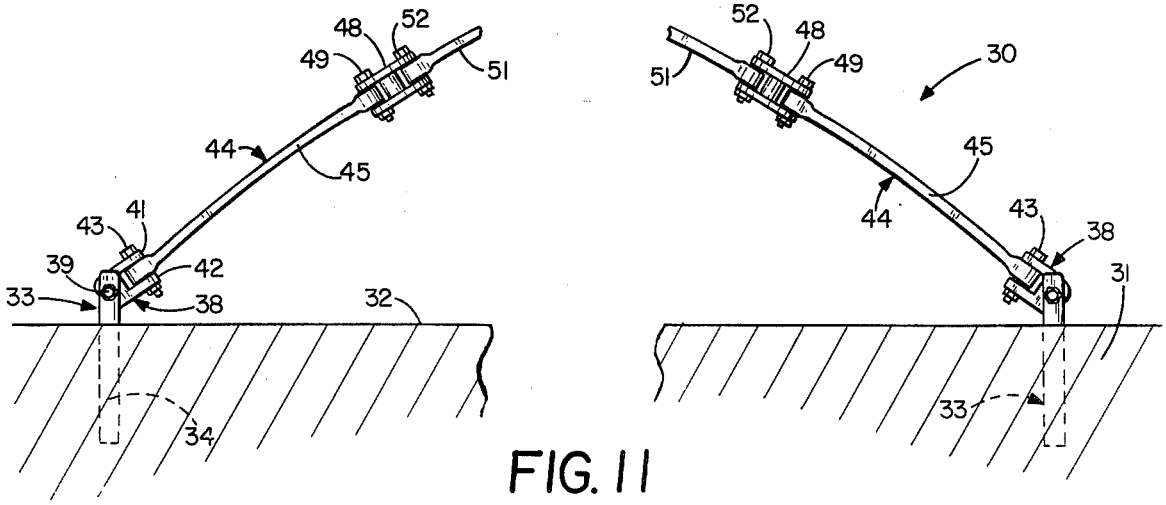
FIG. 11 is a foreshortened sectional view similar to FIG. 2 showing the frame assembly in its erected position.
Figure 6:
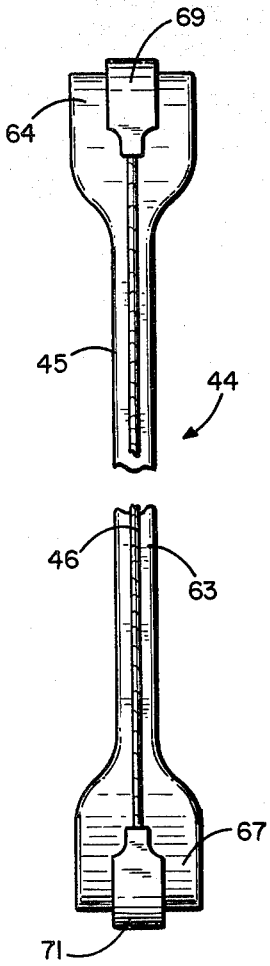
FIG. 6 is a foreshortened side view of the right side of FIG. 4.

Referring to FIGS. 1 and 2, there is shown a rectangular coordinated frame assembly indicated generally at 30 connected to a support 31 having a generally rectangular surface area 32. The support 31 can be the ground, floor, concrete slab, concrete footing, or other supporting structure. Frame assembly 30 is attached to the outer peripheral edge 47 of support 31 with a plurality of anchors 33 spaced about the outer peripheral edge 47. Edge 47 surrounds surface 32. Adjacent anchors 33 on each side of the area 32 are equally spaced from each other.

Figure 3:
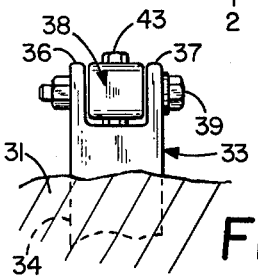
FIG. 3 is an enlarged sectional view taken along the line 3—3 of FIG. 2.

Each anchor 33, as shown in FIG. 3, has an elongated body 34 extended into support 31 to fix the anchor to support 31. The upper portion of body 34 has a pair of upright spaced ears 36 and 37. A clevis indicated generally at 38 located between ears 36 and 37 is pivotally connected thereto with a transverse pivot pin or bolt 39. Clevis 38 has a pair of arms or members 41 and 42 accommodating an end of a first strut assembly 44. A bolt 43 pivotally connects strut assembly 44 to clevis 38. Each strut assembly 44 has a strut 45 and a holding member or cable 46 connected to each end of strut 45 to hold the strut 45 in an arched, curved or bowed position. When strut 45 is in its curved position, the assembly has a minimum length or is contracted. Each anchor 33 accommodates a clevis 38 attached to a first strut assembly 44. The outer end of each strut 45 is pivotally connected to a hub 48 with a bolt and nut assembly 49 or like fasteners.

A second row of strut assemblies 51 connect hubs 48 together. Nut and bolt assemblies 52 connect opposite ends of second strut assemblies 51 to adjacent hubs 48. Each strut assembly 51 has a strut 51A and a holding cable 53 attached to opposite ends of strut 51A to hold the strut in a biased bowed or curved position. Third strut assemblies 54 having a biased bowed or curved strut 55 and holding cord 58 connect hubs 48 to hubs 56. Fourth strut assemblies 59 extend between adjacent hubs 56. Nut and bolt assemblies 61 connect the ends of strut 59 to the hubs 56. Each strut assembly 59 has a biased bowed or curved strut 60 and a holding cable 62 connected to the ends of strut 60 to hold the strut in a biased bowed or curved position adjacent surface 32.

Struts 45, 51A, 55, and 60 are identical in structure and are biased to a curved position by their respective holding cables. Each strut has a generally rectangular cross section with the strut being bowed or curved normal to the long transverse dimension of the strut. The strut has greater resistance to bending in along the transverse length of the strut as its transverse length is greater than the transverse width.

Figure 4:
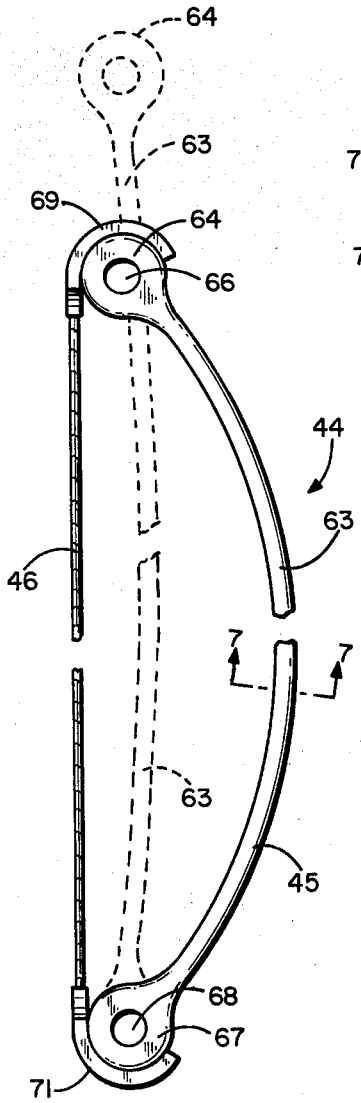
FIG. 4 is an enlarged foreshortened plan view of a strut assembly of the frame assembly of FIG. 1.

A detailed description of strut assembly 44 is shown in FIGS. 4, 5, 6, and 7. Strut assembly 44 has an elongated strut 45 comprising a flexible or elastic body 63. Body 63 is a generally elongated leaf spring having a slightly bowed natural shape, as indicated in broken lines in FIG. 4. A first cylindrical head 64 is joined to the upper end of body 63. Head 64 has a transverse hold 66 to accommodate the bolt used to pivotally fasten the strut assembly to a head 64. The opposite end of body 63 has a second cylindrical head 67 having a transverse hole 68 to accommodate the bolt 43 for pivotally attaching the strut assembly to clevis 38. Preferably, strut assembly 44 is a one-piece reinforced plastic member that is biased to a curved shape, a generally arcuate bowed or arched shape, as shown in FIG. 4, and retained in the curved shape by holding member or cable 46. An example of a strut 44 is an elongated reinforced plastic member having a length of 3 meters and a cross-sectional dimension of 1×2 cm. Other lengths and cross-sectional sizes and materials can be used to make strut 44. For example, strut 45 can be metal, wood, or laminated plastic and wood.

Holding cable 46 has hooks 69 and 71 attached to its opposite ends. Hook 69 fits over head 64 and hook 71 fits over head 67 so that the cable 46 will retain strut 45 in its arcuate bowed position. When cable 46 is released or cut, strut 45 will longitudinally extend and move to its generally elongated position, as shown in broken lines, due to its elastic memory or spring characteristics. Other types of holding members can be used to retain the struts in their curved positions.

Figure 8:
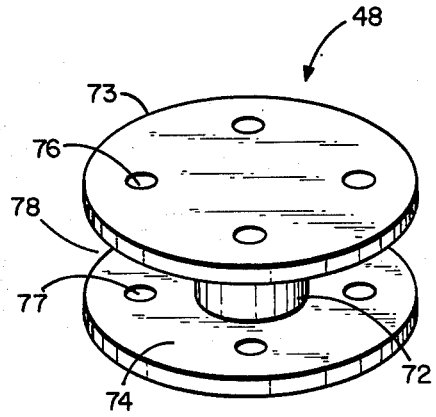
FIG. 8 is a perspective view of a strut connecting hub.
Figure 9:
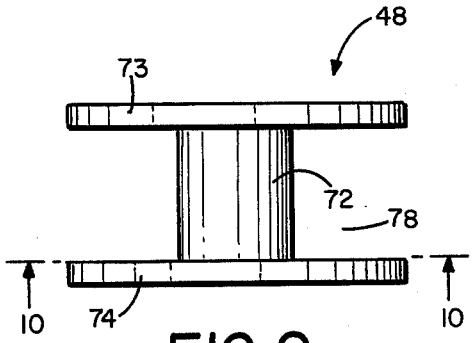
FIG. 9 is a front elevational view of the hub of FIG. 8.
Figure 10:
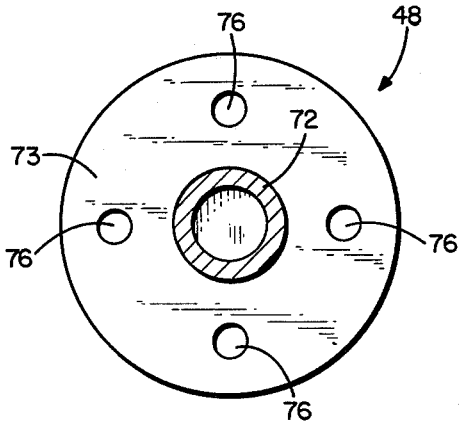
FIG. 10 is a sectional view taken along the line 10—10 of FIG. 9.
Figure 7:
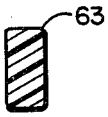
FIG. 7 is an enlarged sectional view taken along the line 7—7 of FIG. 4.
Figure 5:
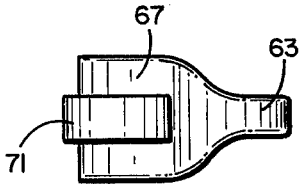
FIG. 5 is a bottom end view of FIG. 4.

Hubs 48 and 56 are identical in structure and connect the adjacent ends of the strut assemblies to form a generally rectangular inter-connected network of strut assemblies and hubs. Referring to FIGS. 8, 9, and 10, hub 48 is a one-piece unit having a cylindrical core 72 and a pair of circular plates 73 and 74. The plates 73 and 74 are secured to opposite ends of core 72 providing hub 48 with an outwardly open annular groove 78. Plates 73 and 74 have aligned holes 76 and 77 to receive the bolts that connect the hub to the strut assemblies. Plates 73 and 74 and core 72 form an annular groove 78 for accommodating the heads of struts 45. Each hub 48 is adapted to be connected to four strut assemblies. The size of the hub can be increased so that additional strut assemblies can be connected thereto. Hub 48 can be a one-piece metal or plastic member. For example, hub 48 can be cast aluminum. Plates 73 and 74 can be attached by welds or bolts to opposite ends of core 72. Hub 56 is identical to hub 48.

As shown in FIGS. 1 and 2, the entire frame assembly 30 is assembled on the surface of the area 32. Anchors 33 are attached to support 31 to define area 32. A clevis 38 is pivotally attached to each anchor 33 with the nut and bolt assembly 39. Clevis 38 pivots about a generally horizontal axis aligned with and parallel to the peripheral edge 47. The outer ends of struts 45 are then connected to hubs 48 with nut and bolt assemblies 39. The remaining strut assemblies 51, 54, and 59 are then interconnected to their adjacent hubs 48 and 56 and any additional hubs that are required to complete the network of the frame assembly over surface 32. This can be accomplished on surface 32 without the need for scaffolding, ladders, and like structures to support workmen in an elevated position. The holding cables 46, 53, and 58 retain the strut assemblies 44, 51, 54, and 59 in their curved contracted positions thereby retaining the frame assembly on surface 32.

Frame assembly 30 is erected by releasing the holding cables 46, 53, 58, and 62. Initially, the center cable 62 is released. This can be accomplished by cutting the cable or releasing one of the hooks from the end of the associated strut. Cables 58 are then released thereby causing strut assemblies 54 to expand or elongate. The struts of the strut assemblies will return from the curved position to their natural elongated position due to the elastic or spring memory of the material of the struts. The expanding strut assemblies will elevate the frame assembly 30 above surface 32. When all of the holding cables have been released, the structure will be fully erected, since the struts will longitudinally elongate to slightly bowed positions, as shown in broken lines in FIG. 4. The struts also will flex in a slight arcuate direction relative to surface 32 so that the frame assembly 30, when erected, will have a dome configuration. Other erected configurations can be made by changing the shape of the peripheral edge 47 surrounding area 32.

Figure 13:
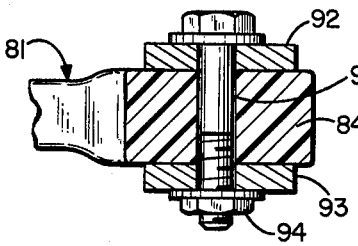
FIG. 13 is an enlarged sectional view taken along the line 13—13 of FIG. 12.
Figure 12:
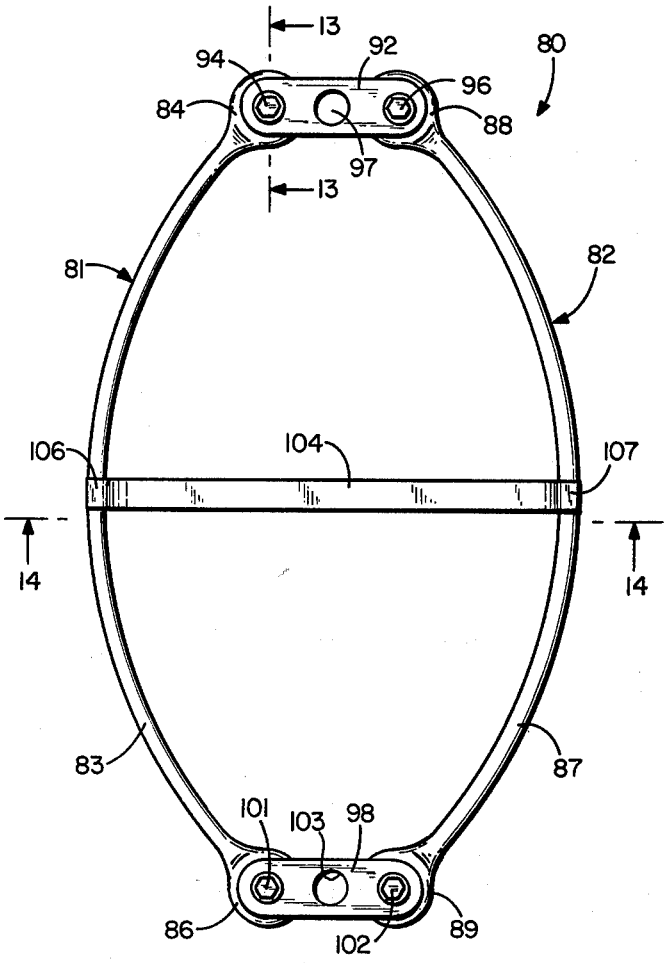
FIG. 12 is a front elevational view of a modification of a strut assembly of the invention.
Figure 16:
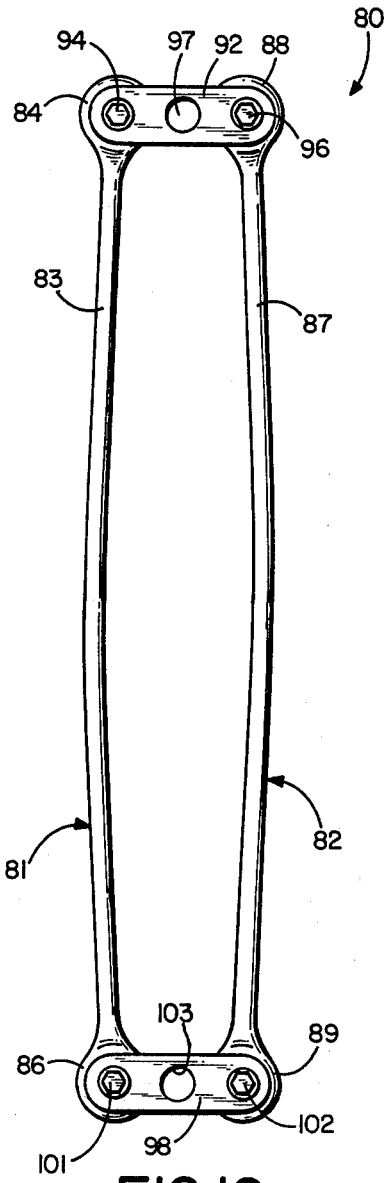
FIG. 16 is an elevational view of a second modification of a strut assembly of the invention.
Figure 15:
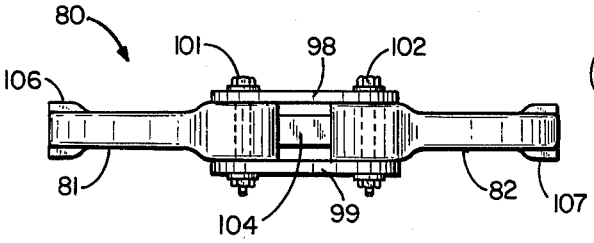
FIG. 15 is an elevational view showing the strut assembly of FIG. 12 in its elongated position.

Referring to FIGS. 12–16, there is shown a first modified strut assembly 80 that can replace the strut assemblies 44, 51, and 54 of frame assembly 30. Strut assembly 80 has a pair of elongated spring struts 81 and 82 that can be flexed to opposite curved, arcuate or bowed positions, as shown in FIG. 12. Struts 81 and 82 have a natural slightly bowed elongated position, as shown in FIG. 16. Strut 81 has an elongated body 83 connected at its opposite ends to cylindrical heads 84 and 86. Strut 82 has an elongated body 87 connected to cylindrical heads 88 and 89. Struts 81 and 82 are identical in structure and length. As shown in FIG. 13, head 84 has a hole 91 in vertical alignment with holes in links 92 and 93. A nut and bolt assembly pivotally connects links 92 and 93 to the head 84. Head 88 has a hole accommodating a nut and bolt assembly 96 that pivotally connects links 92 and 93 to strut 82. Heads 86 and 89 have holes that accommodate nut and bolt assemblies 101 and 102 to pivotally connect links 98 and 99 to heads 86 and 89, as shown in FIG. 15.

Links 92 and 93 have central aligned holes 97 for accommodating nut and bolt assemblies to connect the strut assembly 80 to a hub or an anchor clevis. Links 98 and 99 have central holes 103 for accommodating nut and bolt assemblies to connect the strut assembly to a hub or anchor clevis.

Figure 14:
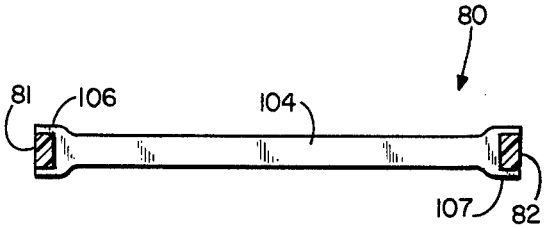
FIG. 14 is a sectional view taken along the line 14—14 of FIG. 12.

Strut assembly 80 is held in its curved contracted position, as shown in FIGS. 12 and 14, with a transverse holding member 104. Holding member 104 is a rigid link located between the mid-sections of struts 81 and 82. Member 104 serves as a rigid compression link that holds the bodies 83 and 84 in outwardly curved or bowed positions. The outer ends of holding member 104 are bifurcated and fit over the center portions of bodies 83 and 87 so that the spring or biasing force of struts 81 and 82 will retain the holding member 104 in assembled relation with struts 81 and 82. When holding member 104 is removed, struts 81 and 82 will return to their natural elongated position, as shown in FIG. 14. This increases the length of the strut assembly 80. When strut assembly 80 is used in a frame assembly, an increase in the length of the strut assembly 80 will cause an erection of the frame assembly.

Figure 17:
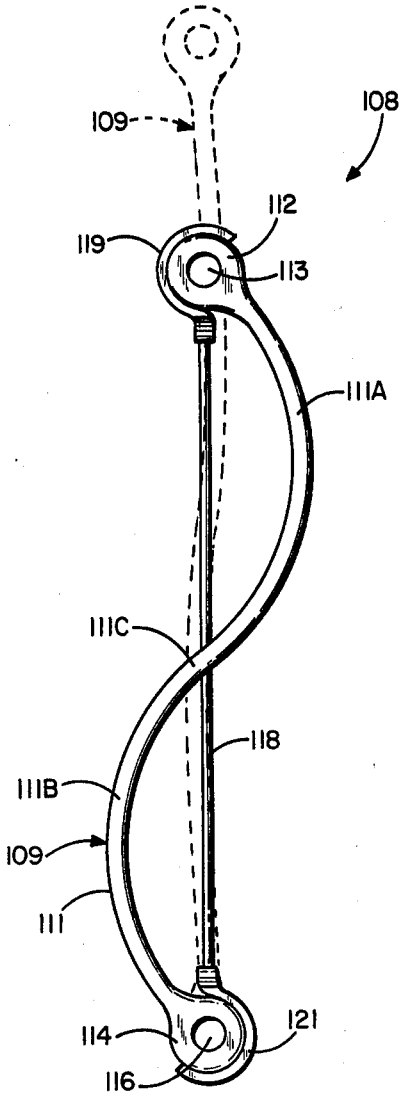
FIG. 17 is a sectional view showing the S-curved shape of the strut assembly of FIG. 16.
Figure 18:
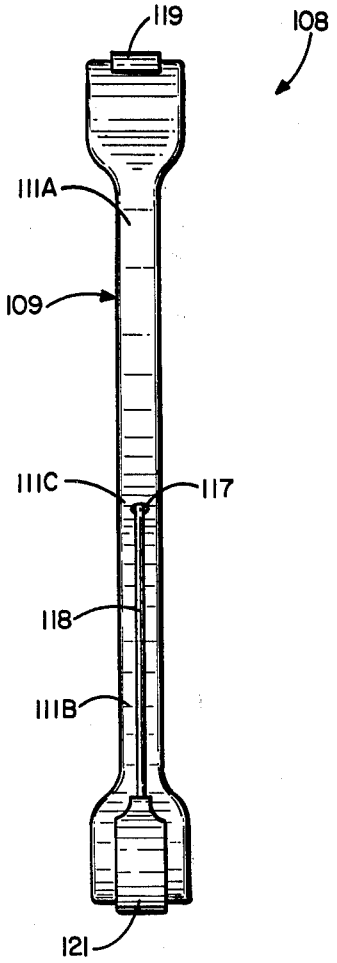
FIG. 18 is a side view of the right side of FIG. 17.
Figure 19:
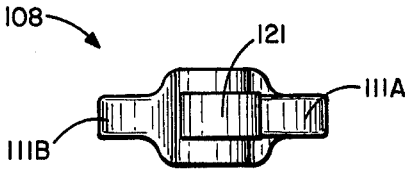
FIG. 19 is a bottom end view of FIG. 16.

Referring to FIGS. 17, 18, and 19, there is shown a second modification of a strut assembly indicated generally at 108 useable with the anchors and hubs to form a frame assembly. The strut assembly 108 has a S-curved strut 109 having a flexible spring body 111. Opposite ends of body 111 are attached to cylindrical heads 112 and 114. Head 112 has a transverse hole 113 to receive a nut and bolt assembly for connecting the strut assembly to an anchor or hub. Head 114 has a hole 116 for a connector, as a bolt or pin, to attach the strut to an anchor or hub. Body 111 is a S-shaped leaf spring having a first curved section 111A and a reverse curved second section 111B. The mid-section 111C of the body is in general alignment with a line extended between cylindrical heads 112 and 113.

A holding member 118, such as a cable, connected to hooks 119 and 121 holds body 111 in a generally S-shape to retain the strut assembly 108 in a longitudinally contracted position. Holding member 118 can be a cable, wire, cord, or the like. Other types of holding members 118 can be used to retain body 111 in a biased S-shape. Body 111 can be made of reinforced plastic that has an elastic memory. Other materials, as wood and metal, can be used to make the S-curved strut.

Figure 20:
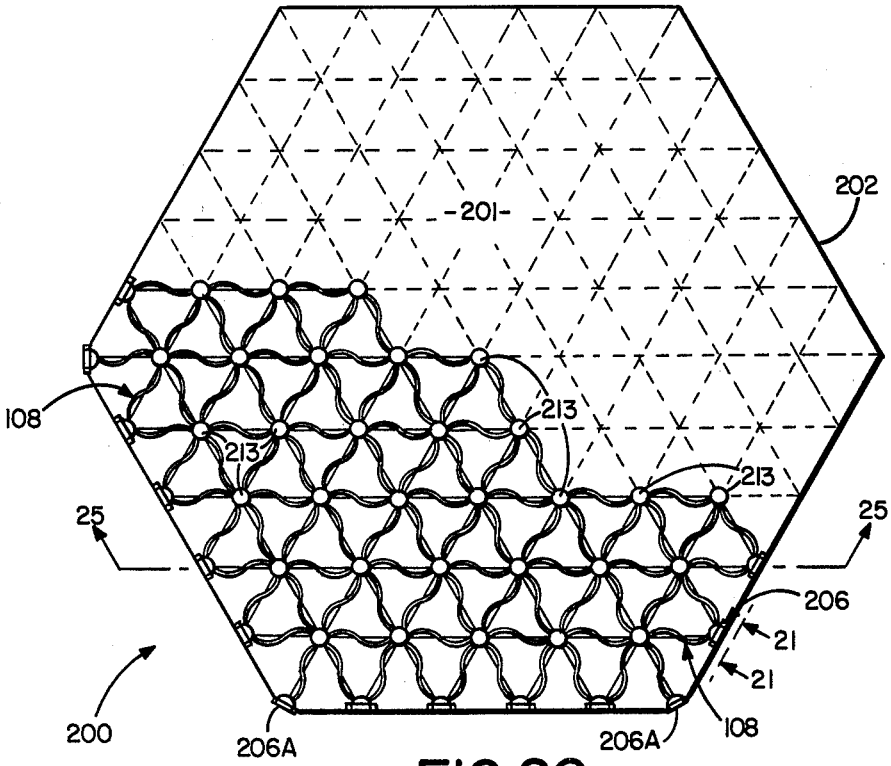
FIG. 20 is a top plan view of a second frame assembly of the invention.
Figure 21:
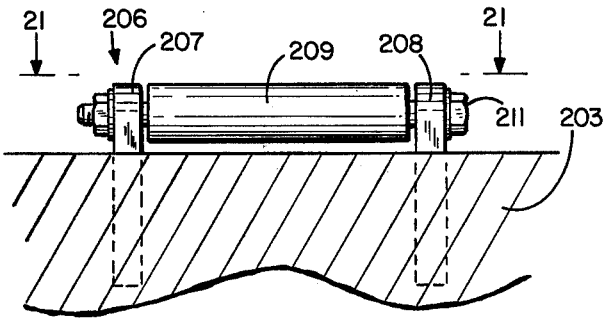
FIG. 21 is an enlarged sectional view taken along the line 21—21 of FIG. 20.
Figure 22:
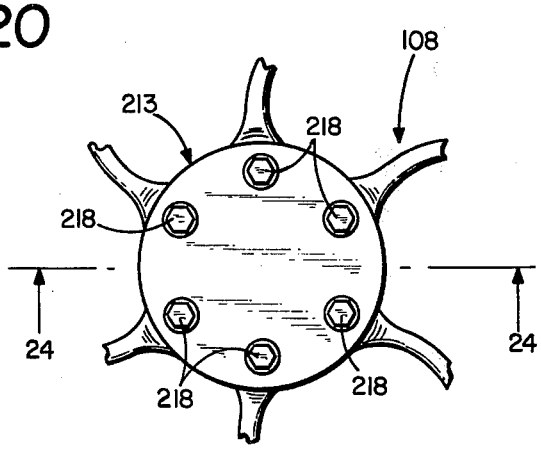
FIG. 22 is an enlarged plan view of a hub connected to a plurality of strut assemblies.
Figure 23:
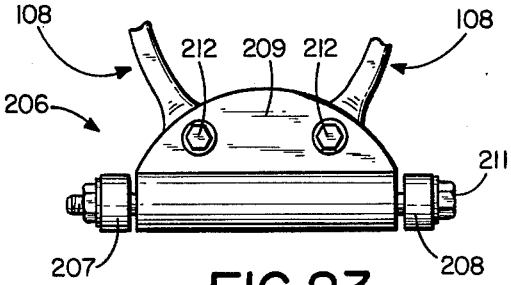
FIG. 23 is a view taken along the line 19—19 looking in the direction of the arrows.
Figure 24:
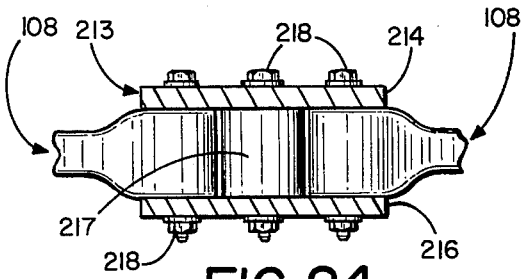
FIG. 24 is an enlarged sectional view taken along the line 24—24 of FIG. 22.

In use, strut assemblies 108 are connected to the anchors and hubs on the surface in their contracted positions, as shown in full lines in FIG. 17. The inter-connected strut assemblies 108 form a frame network covering a defined surface, as a square, rectangle, circle, hexagon, or the like. A hexagonal network is shown in FIG. 20. When all of the strut assemblies 108 and hubs 213 and anchors 206 have been connected together to form a frame assembly, the holding members 118 are released thereby allowing each strut assembly 108 to extend in a longitudinal direction to erect the frame assembly. The holding members 118 of the center strut assemblies are initially released so that the center of the frame assembly is first raised. The holding members 118 adjacent the center strut assemblies are then released to further raise the center of the frame assembly above the area 201 covered by the frame assembly. When the strut assemblies are fully elongated, they will have a slight S-curved shape, as shown in broken lines in FIG. 17. This is the normal shape of strut assemblies 108.

Figure 25:
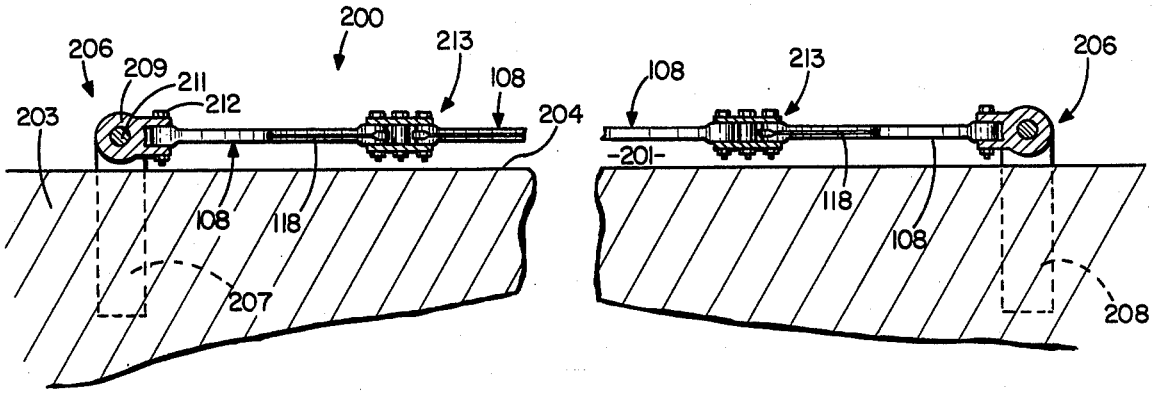
FIG. 25 is an enlarged foreshortened sectional view taken along the line 25—25 of FIG. 20.

Referring to FIGS. 20–24, there is shown a modification of the frame assembly indicated generally at 200. The frame assembly 200 has a generally hexagonal shape covering a hexagonal area 201. Area 201 has a hexagon-shaped outer peripheral edge 202. Frame assembly 200 is assembled on a generally horizontal support, such as a ground support 203 or a floor. As shown in FIG. 25, support 203 has a top surface 204 forming the area 201 covered by the frame assembly 200.

A plurality of spaced anchor units indicated generally at 206 are spaced around the outer peripheral edge 202. Each anchor unit 206 has a pair of posts 207 and 208 extended down into and anchored to support 203. A clevis 209 is located between posts 207 and 208. A transverse bolt 211 pivotally connects clevis 209 to the upper ends of posts 207 and 208. Clevis 209 pivots about a generally horizontal axis.

Nut and bolt assemblies 212 connect a pair of struts 108 to each clevis 209. The anchor unit 206A, shown in the corners of outer edge 202, is connected to a single strut assembly 108. The strut assembly 108 is the S-curved strut assembly shown in detail in FIGS. 17–19. The strut assemblies 44, 80, shown in FIGS. 4–7 and 12–16, can be used in lieu of strut assembly 108 in frame assembly 200.

The ends of strut assemblies 108 spaced from anchors 206 are connected to hubs indicated generally at 213. As shown in FIG. 2, hub 213 has a circular top plate 214 spaced above a circular bottom plate 216. A cylindrical central core 217 connects plates 214 and 216 and forms an annular groove or pocket for accommodating the ends of strut assemblies 108. Plates 214 and 216 have a plurality of holes for accommodating nut and bolt assemblies 218 which pivotally connect the ends of the strut assemblies 108 to hub 213. The strut assemblies 108 can be fixed to hubs 213 in a non-rotatable manner. When strut assemblies 108 are non-rotatably connected to hubs 213, the hubs 213 rotate about their axes as the strut assemblies 108 expand to erect the frame assembly.

As shown in FIG. 25, frame assembly 200 is assembled in a generally horizontal plane on surface 204. Strut assemblies 108 are in their curved contracted positions with the holding members 118 retaining the bodies of the strut assembly in a generally S-shaped configuration. The outer strut assemblies are connected to the clevises 209 of anchors 206. The frame assembly is completed by connecting the opposite ends of the strut assemblies 108 of units 213. The nut and bolt assemblies 218 pivotally connect strut assemblies 108 to hubs 213. Non-pivoting connectors can be used to attach strut assemblies to hubs 213.

Figure 26:
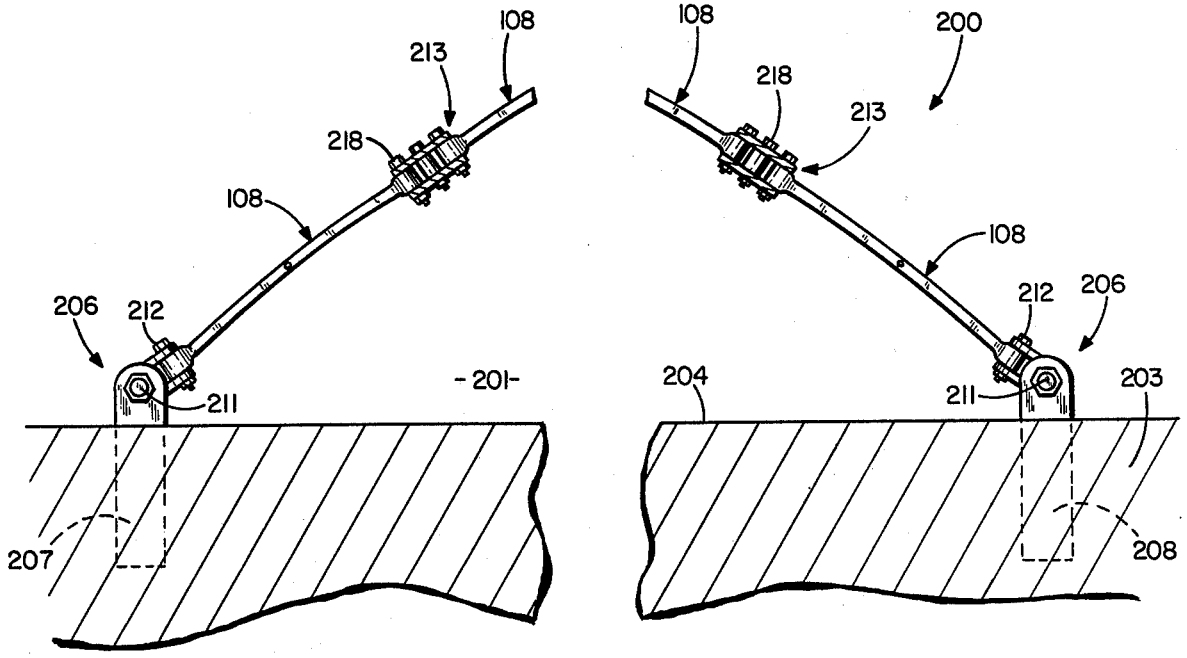
FIG. 26 is a sectional view similar to FIG. 25 showing the frame assembly of FIG. 24 in the erected position.

Frame assembly 200 is erected by releasing restraining means or holding members 118. Initially, holding members 118 in the center of the frame assembly 200 are released thereby elongating the central strut assemblies. This will initially move the center of the frame assembly in an upward direction. The erection process is continued by progressively releasing holding members 118 in an outward direction until all of the holding members 118 are released. As shown in FIG. 25, when holding members 118 are released, the strut assemblies 108 are in their elongated positions. The outer strut assemblies pivot with the clevises 209 about horizontal axes, as shown in FIG. 26. The frame assembly is in an elevated or erected position over the surface 204. Holding members 118 can be released in any order; for example, the holding members 118 can be progressively released from one side of the frame assembly or two or more sides of the frame assembly to erect the frame assembly.

Frame assembly 30 can be erected by releasing the holding cables 46, 53, 58, and 62 in any order. When all of the holding cables are released, the frame assembly is fully erected above surface area 32.

While there has been shown and described several preferred embodiments of the frame assembly, strut assembly, hubs and anchors, and arrangement or networks of strut assemblies and hubs over a surface, it is understood that changes in these structures and arrangements of structures can be made by those skilled in the art without departing from the invention. The invention is defined in the following claims.

The embodiments of the invention in which an exclusive property or privilege is claimed are defined as follows:

1. A frame assembly located over a surface surrounded by an outer peripheral edge comprising: a plurality of anchor means spaced along said outer peripheral edge, a plurality of strut assemblies located adjacent said surface, means pivotally connecting some of said strut assemblies to the anchor means, hub means connected to adjacent strut assemblies to form a network of strut assemblies and hub means located over the surface, each of said strut assemblies having at least one spring strut that can be biased from an elongated position to a curved contracted position, and holding means retaining the strut in said curved contracted position, said holding means being releasable whereby the spring strut moves from said contracted position to said elongated position thereby moving the frame assembly away from the surface to an erected position.

2. The frame assembly of claim 1 wherein: each anchor means has a fixed first member and a second member movably mounted on the fixed first member, said means pivotally connecting some of said strut assemblies to the anchor means being connected to the second member.

3. The frame assembly of claim 2 wherein: pivot means pivotally connect the second member to the first member for movement about a generally horizontal axis.

4. The frame assembly of claim 2 wherein: the second member is a clevis adapted to accommodate a pivot member connecting a strut assembly to the clevis.

5. The frame assembly of claim 1 wherein: the hub means has a center core and disc members attached to said core forming a groove to accommodate a portion of the strut assemblies, and pivot means pivotally connecting the portion of the strut assemblies to the discs.

6. The frame assembly of claim 1 wherein: each strut has an elongated body having opposite ends, a first head attached to one end of the body, and a second head attached to the other end of the body.

7. The frame assembly of claim 6 wherein: each head has a hole for accommodating pivot means for connecting one head to the anchor means and the other head to the hub means.

8. The frame assembly of claim 6 wherein: each head is wider than the cross sectional length of the body.

9. The frame assembly of claim 6 wherein: the body has a cross sectional length that is substantially longer than the cross section width thereof.

10. The frame assembly of claim 9 wherein: said length is about twice said width.

11. The frame assembly of claim 1 wherein: each strut assembly includes a plurality of spring struts, and holding means retaining each strut in a curved contracted position, said holding means being releasable whereby each spring strut elongates and moves the frame assembly away from the surface to an erected position.

12. The frame assembly of claim 1 wherein: each strut assembly includes a pair of spring struts, each strut having a first end and second end opposite the first end, means connecting adjacent first and second ends of the struts, and holding means engageable with the struts to retain each strut in a curved contracted position.

13. The frame assembly of claim 12 wherein: the means connecting adjacent first and second ends of the struts comprise plate means pivotally connected to said ends, said plate means being connected to either of said anchor means or hub means.

14. The frame assembly of claim 12 wherein: said holding means comprises at least one rigid link engageable with the mid-sections of said pair of spring struts.

15. The frame assembly of claim 1 wherein: each strut assembly has a S-curved spring strut, and holding means retaining the S-curved spring strut in a S-curved contracted position, said holding means being releasable whereby the S-curved spring strut elongates and moves the frame assembly away from the surface to an erected position.

16. The frame assembly of claim 15 wherein: each spring strut has a S-curved body having a first end and second end opposite the first end, a first head attached to the first end, a second head attached to the second end, said first and second head each adapted to be connected to said anchor means or hub means.

17. The frame assembly of claim 16 wherein: said holding means includes an elongated member, said body having a mid-section with a hole, said elongated member extended through said hole, and means attaching the elongated member to opposite end portions of the strut.

18. The frame assembly of claim 16 wherein: the hub means has laterally spaced members providing a groove for accommodating a head, and pivot means pivotally connecting the accommodated head to said spaced members.

19. The frame assembly of claim 1 wherein: the holding means comprises a member extended between and attached to opposite end portions of the strut.

20. The frame assembly of claim 19 wherein: the holding means includes hook means attached to the member to connect the member to said opposite end portions of the strut.

21. A strut assembly for use in a frame assembly having hub means, said frame assembly being located over a surface surrounded by an outer peripheral edge and a plurality of anchors spaced along said outer peripheral edge comprising: elongated spring strut means adapted to be connected to the anchor means, said strut means including at least one elongated spring strut that can be biased from an elongated position to a curved contracted position, and holding means retaining the strut in said curved contracted position, said holding means being releasable whereby the spring strut moves from the curved contracted position to its elongated position.

22. The strut assembly of claim 21 wherein: each strut has an elongated body, said body having a first end and a second end opposite the first end, a first head attached to the first end of the body, and a second head attached to the second end of the body.

23. The strut assembly of claim 22 wherein: each head has a hole for accommodating pivot means for connecting a head to the anchor means or a hub means.

24. The strut assembly of claim 22 wherein: each head is wider than the cross sectional length of the body.

25. The strut assembly of claim 21 wherein: the body has a cross sectional length that is substantially longer than the cross sectional width thereof.

26. The strut assembly of claim 25 wherein: said length is about twice said width.

27. The strut assembly of claim 21 wherein: each strut means includes a plurality of struts, each of said struts being biased from an elongated position to a curved contracted position, and holding means retaining each strut in a curved contracted position, said holding means being releasable whereby each strut elongates to its elongated position.

28. The strut assembly of claim 21 wherein: each strut means includes a pair of spring struts, each of said pair of spring struts having a first end and a second end opposite the first end, means connecting the adjacent first and second ends of the struts, and holding means engageable with the struts to retain each strut in said curved contracted position.

29. The strut assembly of claim 28 wherein: the means connecting adjacent first and second ends of the struts comprise plate means pivotally connected to said ends, said plate means being connected to either of said anchor means or hub means.

30. The strut assembly of claim 28 wherein: said holding means comprises at least one rigid link engageable with the mid-sections of said pair of spring struts.

31. The strut assembly of claim 28 wherein: said pair of struts are biased to opposite bowed positions and retained in said bowed positions by the holding means.

32. The strut assembly of claim 21 wherein: each strut means has a S-curved spring strut, said strut being biased from an elongated position to a S-curved contracted position, and holding means retaining the S-curved spring strut in said S-curved contracted position, said holding means being releasable whereby the S-curved spring strut moves to an elongated position.

33. The strut assembly of claim 32 wherein: the spring strut has a S-curved body having a first end and a second end opposite the first end, a first head attached to the first end, a second head attached to the second end, said first and second heads each adapted to be connected to said anchor means or said hub means.

34. The strut assembly of claim 33 wherein: each of said first and second heads have a width greater than the cross sectional length of the body.

35. The strut assembly of claim 33 wherein: the body has a cross sectional length that is substantially longer than the cross sectional width thereof.

36. The strut assembly of claim 32 wherein: said holding means includes an elongated member, said strut having a mid-section with a hole, said elongated member extended through said hole, and means attaching the elongated member to opposite end portions of the strut.

37. The frame assembly of claim 21 wherein: the holding means comprises a member extended between and attached to opposite end portions of the strut.

38. The frame assembly of claim 37 wherein: the holding means includes hook means attached to the member to connect the member to said opposite end portions of the strut.

39. A method of making a frame assembly over a surface comprising: bending strut means into curved contracted positions, retaining said strut means in said curved contracted positions with holding means, arranging on the surface a plurality of curved contracted strut assemblies, said strut means having opposite ends, attaching one end of some of said strut means to said anchor means, attaching the remaining ends of said strut means to hub means, releasing the holding means to allow said strut means to elongate to their elongated positions whereby said strut assemblies and hub means move away from the surface erecting the frame assembly over the surface.

40. The method of claim 39 including: pivotally connecting ends of said strut means to said anchor means and hub means.

41. The method of claim 39 wherein: the plurality of said strut assemblies are arranged on said surface in a generally rectangular pattern.

42. The method of claim 39 wherein: the plurality of said strut assemblies are arranged on said surface in a generally hexagonal pattern.

43. The method of claim 39 wherein: each strut means is biased to a bowed contracted position.

44. The method of claim 39 wherein: the strut means comprise a pair of struts biased in opposite bowed contracted positions.

45. The method of claim 39 wherein: each strut means is biased to a S-curved contracted position.

* * * * *